US005327857A

United States Patent [19]

Howell

[11] Patent Number: 5,327,857

[45] Date of Patent: Jul. 12, 1994

[54] VEHICULAR DRIVE SYSTEM USING STORED FLUID POWER FOR IMPROVED EFFICIENCY

[76] Inventor: Roy M. Howell, 115 Meadbrook Rd., Garden City, N.Y. 11530

[21] Appl. No.: 924,218

[22] Filed: Aug. 3, 1992

[51] Int. Cl.[5] ..... F02B 71/04

[52] U.S. Cl. ..... 123/46 R

[58] Field of Search ..... 123/46 R, 46 SC, 46 E

[56] References Cited

U.S. PATENT DOCUMENTS

| | | | |
|---|---|---|---|
| 2,983,098 | 5/1961 | Bush | 123/46 R |
| 3,024,591 | 3/1962 | Ehrat et al. | 123/46 R |
| 3,182,895 | 5/1965 | Panhard | 123/46 R |
| 3,998,049 | 12/1976 | McKinley et al. | 123/46 R |
| 4,308,720 | 1/1982 | Brandstadter | 123/46 R |
| 4,530,317 | 7/1985 | Schutten | 123/46 R |
| 4,665,703 | 5/1987 | David | 123/46 R |
| 4,776,166 | 10/1988 | Dixon | 123/46 R |

*Primary Examiner*—Tony M. Argenbright
*Assistant Examiner*—M. Macy
*Attorney, Agent, or Firm*—Kane, Dalsimer, Sullivan, Kurucz, Levy, Eisele and Richard

[57] ABSTRACT

A road vehicle drive system using a crankless, unthrottled internal combustion engine directly powering its wheels hydrostatically to eliminate wasteful idling and part-throttle operation so that fuel use and harmful emissions are much reduced in a lighter, less costly vehicle retaining the operational convenience of conventional systems.

10 Claims, 5 Drawing Sheets

VEHICULAR DRIVE SYSTEM USING STORED FLUID POWER FOR IMPROVED EFFICIENCY

BACKGROUND OF THE INVENTION

This invention relates to drive systems and especially to automotive drive systems. A system is presented which converts internal combustion power to stored fluid power without the use of crank mechanisms or piston bounce chambers and uses that stored power to drive road or other vehicles.

Automotive drive systems currently used are major contributors to air pollution and fossil fuel reserve depletion. Stored energy drive systems in which an internal combustion engine is run primarily at its high efficiency conditions, its energy stored and used as needed can drastically reduce those drawbacks.

No practical system of this type is in use today. Among the factors contributing to that apparent impracticality are these, in random order:

1. Overly complex and bulky hydro-mechanical arrangements.
2. Lack of accommodation for ambient atmospheric condition variation.
3. Excessive fluid flow-losses in valves and passages.
4. Inadequate leakage compensation and control.
5. Unacceptable vibration.
6. Overly complex power piston synchronization means.
7. Lack of simple starting arrangements.
8. Lack of adequate controls.

SUMMARY OF THE INVENTION

In this invention, a system is presented which enables the many elements necessary in a road vehicle drive system acceptable to the ordinary driver-owner to be utilized and thus provide great benefits at acceptable cost. Among others, the objects and advantages of this invention are:

1. Means for adjusting the accumulator pressures to the variations in atmospheric conditions. This permits the effective operation of the drive system over the wide range of atmospheric conditions to which road vehicles are subjected.
2. The utilization of a stepped-diameter piston in the simplified main fluid flow passages to synchronize the power pistons. This eliminates the cumbersome external mechanisms used here-to-fore.
3. The utilization of a compression initiating valve release system controlled for both pressure and time. This permits release of this valve at the maximum pressure level appropriate to the ambient atmospheric conditions with sufficient time delay to insure optimum charging of the cylinder with fresh mixture.
4. The utilization of synchronized opposed pistons in cylinders at a broad "Vee". This insures that the pistons and the piston/fluid flow masses will have minimum vibrational effects.
5. The utilization of a piston start-up cycling system isolated from the normal running of the engine. This insures a start-up system free from the wear, tear, noise and friction involved in engine running.
6. Means for monitoring the positional relationship of the three main pistons and methods of adjusting the same to a normal relationship if out of position. This permits establishment of a normal positional relationship among the three main pistons at start-up and the continued correction for any errors brought about by leakage or other factors.
7. The utilization of an hydraulic processing unit for sequencing in conjunction with the computing unit the various operations involved in pre-start-up system conditioning, engine start-up, engine running, and system shut-down. This provides the auxiliary hydraulic functions required in the system's operation.
8. The utilization of computer means which is programmed to process the inputs from the atmospheric sensors, pressure, temperature and humidity, the piston synchronization pick-ups, the start-up system switches, the delay time element and other inputs essential to proper road vehicle use and control.
9. The utilization of shut-off valves between the high and low pressure fluid storage chambers and the system's drive motor to be closed whenever no drive power is needed. Such shut-off valves substantially eliminate a major source of fluid power loss through leakage.
10. The providing of means of shutting off fluid flow from high pressure accumulator when motor overspeeding occurs.

DESCRIPTION OF THE PREFERRED EMBODIMENT

Figure 1:
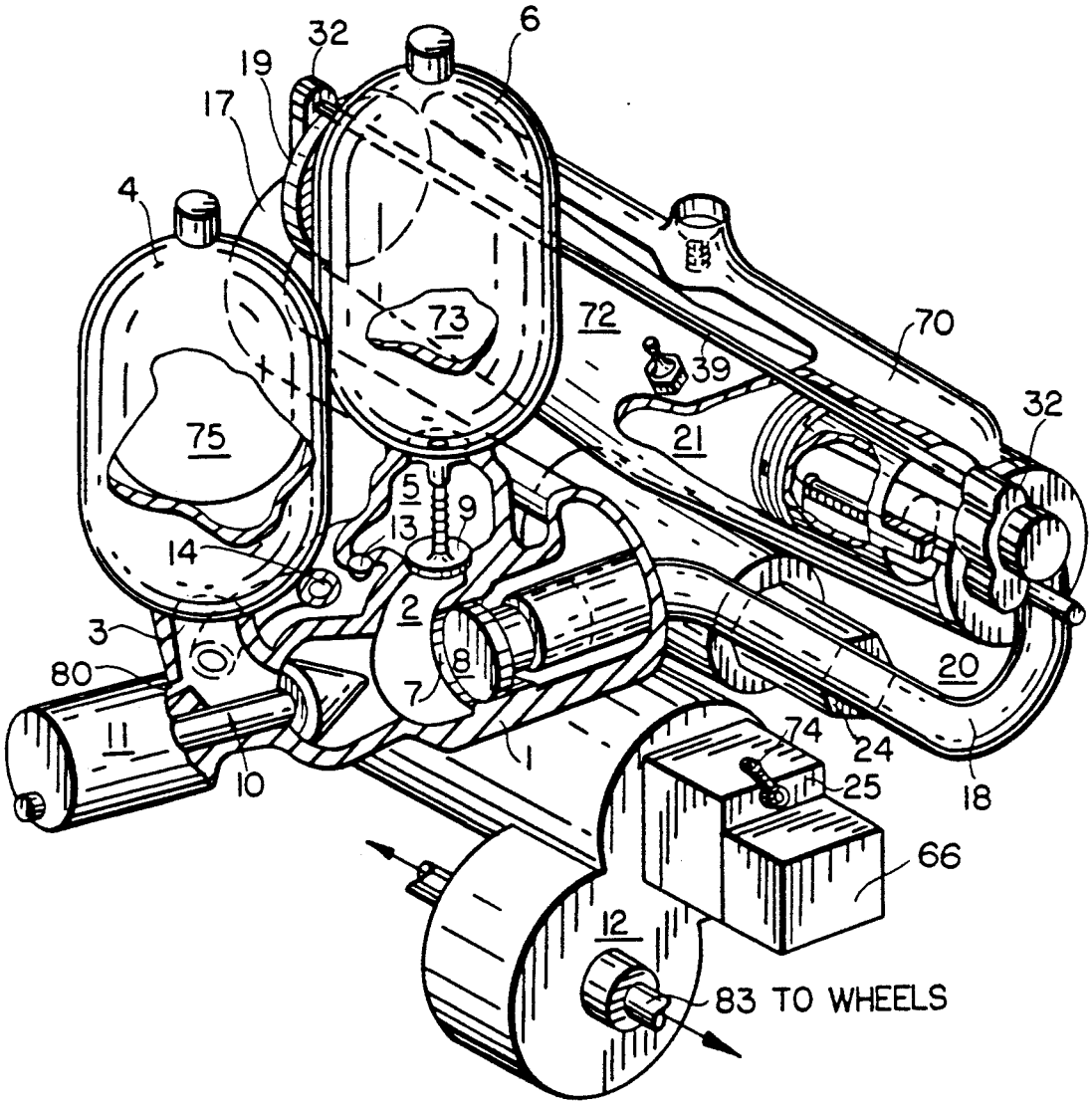
FIG. 1 is an isometric view showing the general arrangement of the invention.
Figure 2:
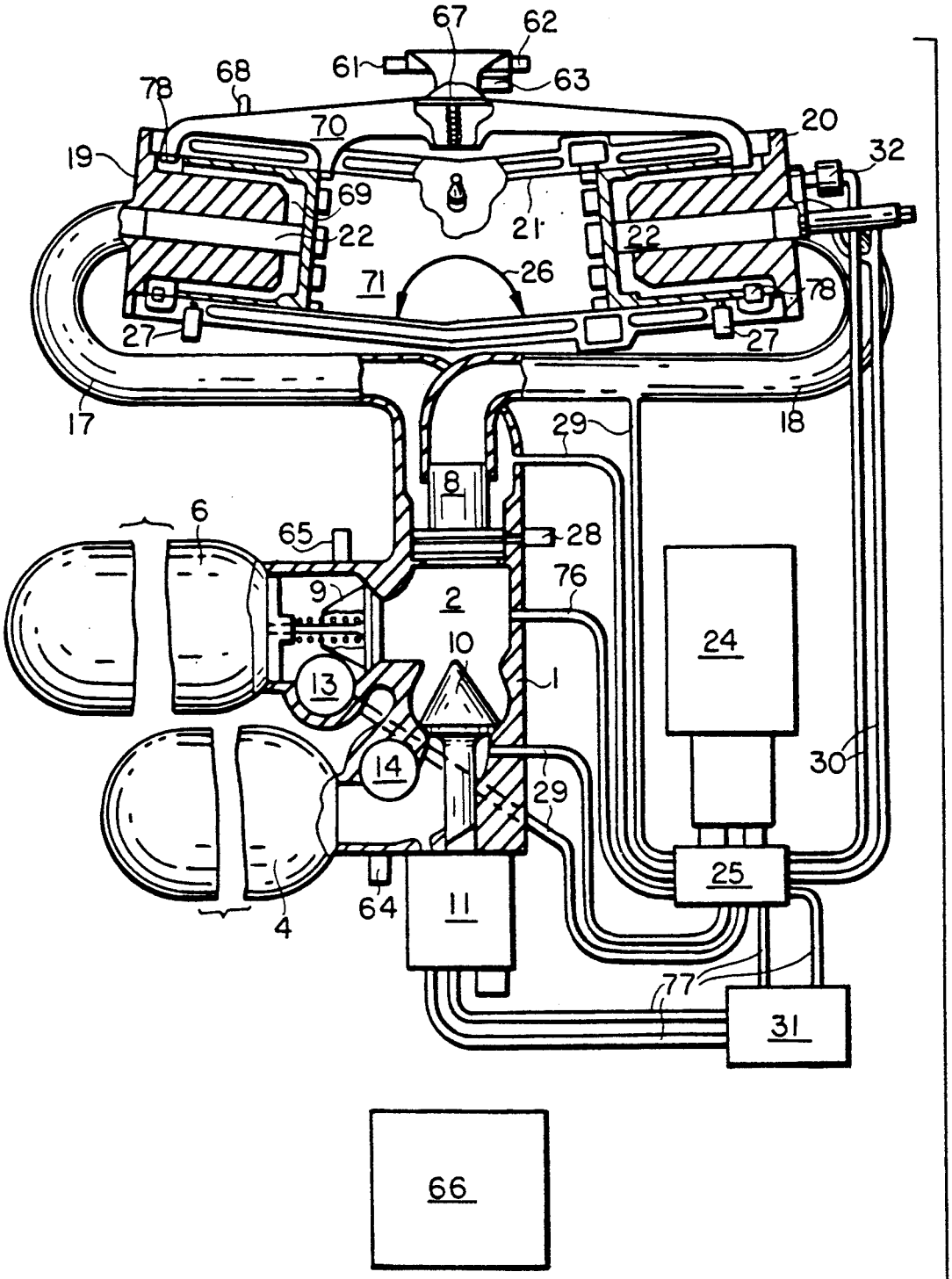
FIG. 2 is a detailed schematic drawing of the system shown in FIG. 1 illustrating the sensors and hydraulic control lines.

FIG. 1 is an isometric view showing the general arrangement of the basic elements of the internal combustion power conversion to stored fluid power system which this invention embodies and FIG. 2 is a schematic thereof. As seen in the FIGURES and especially in FIGS. 1 and 2, main housing 1 contains a main fluid chamber 2, a fluid passage 3 from a low pressure accumulator 4 to chamber 2, a fluid passage 5 from a high pressure accumulator 6 to chamber 2 and a two-diameter coaxial synchronizing cylinder 7 having slidably mounted therein, a two diameter synchronizing piston 8.

Figure 5:
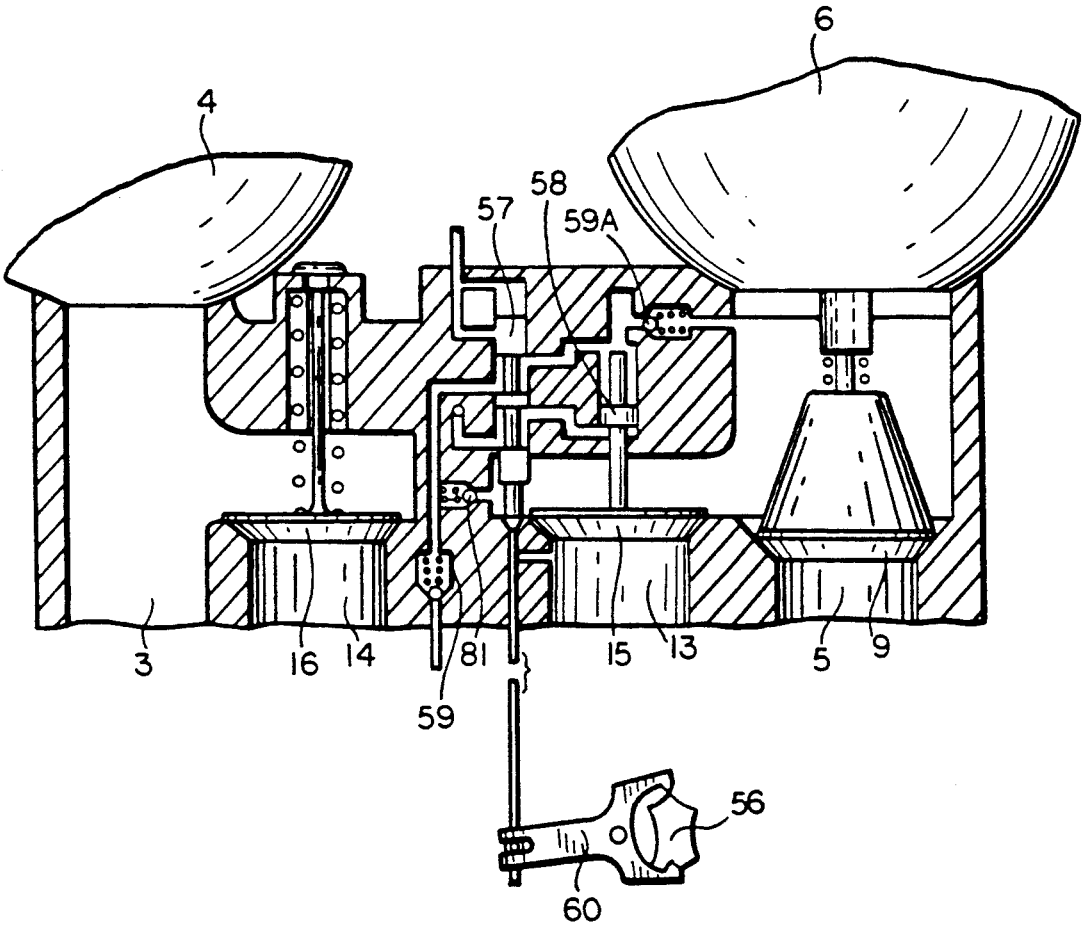
FIG. 5 is a schematic drawing of the accumulator-to-motor fluid flow shut-off valve provisions of the system.

Low pressure accumulator 4 with its bladder 75 which is attached to the main housing is open to passage 3. Thus passage 3 connects the main chamber to the low pressure accumulator. Attached in similar fashion to the main housing at passage 5, is high pressure accumulator 6 with its check valve 9. Thus passage 5 connects the main chamber to the high pressure accumulator. Assembled into the housing 1 is compression initiating valve 10, with its retention/release mechanism 11. Variable volume reversible hydraulic drive motor 12, including its gear box with shaft 83 to wheels, is also attached to the main housing. The input port of motor 12 forms a fluid passage with port 13 of passage 5, and its output port forms a fluid passage with port 14 of passage 3. These passages contain shut-off poppet as shown or rotary valves 15 and 16 as seen in FIG. 5.

Figures 3, 3A:
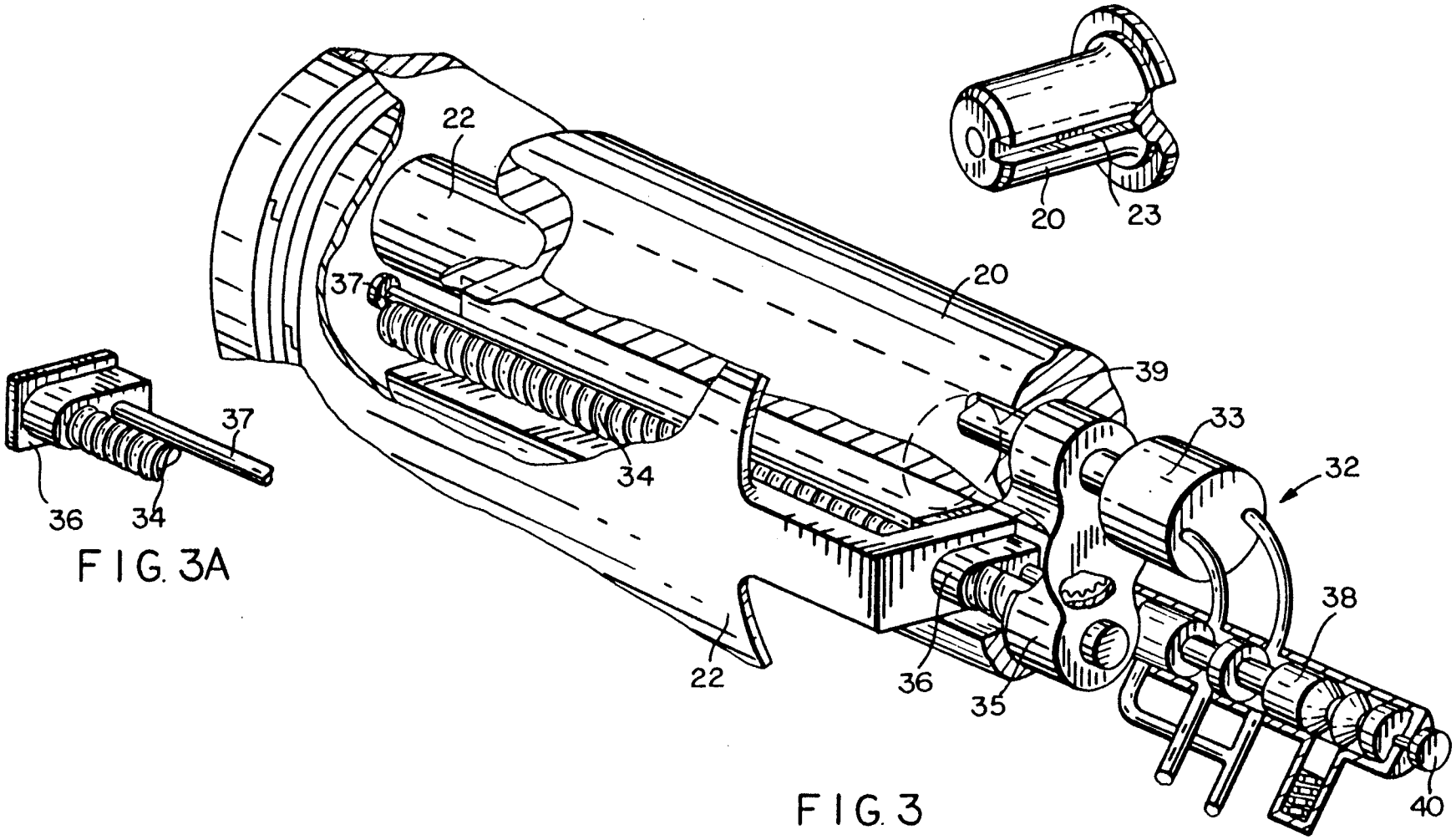
FIGS. 3 and 3*a* show an isometric view of the power piston used in the invention and its start-up cycling mechanism.

Synchronizing cylinder 7 is connected to fluid passages, 17 and 18, which are, in turn, connected respectively to engine end-fittings 19 and 20 to form continuous fluid passages between the two pumping cylinders and the synchronizing cylinders. Engine end-fittings 19 and 20 close internal combustion cylinder 21 and provide pumping cylinders for hydraulic pump pistons integral with power pistons 22. They provide slots 23, as shown in FIG. 3, which guide tongues on each power piston during reciprocation.

A battery-powered starter motor 24 with attached hydraulic pump is provided. The numeral 25 identifies a hydraulic processing unit containing the valves and injection pumps necessary to its functions.

FIG. 2 shows schematically and in somewhat greater detail than FIG. 1, the elements making up the invention without the drive motor and its associated shut-off valves. The relationships among the internal combustion power assembly, the hydraulic passages and elements, the control sensors, the hydraulic circuits and the computer unit without its wiring and power source are seen therein. Combustion cylinder 21 is configured of two arms joined at the center of cylinder 21 to form a wide obtuse angle or broad "Vee" 26 to balance the inertia forces produced by the high accelerations of fluid flow and power piston 22 masses. The spark-ignited, two-cycle nature of the engine unit is seen clearly in FIG. 2.

Power piston position sensors 27, and synchronizing piston position sensor 28, are shown in their approximate relative locations. The bleed/charge lines 29, from the hydraulic processing unit 25, are shown connected to their appropriate passages and chambers. Lines 30 to the power piston start-up reciprocating system are shown also, as is fluid reservoir 31 with its connecting lines 77 to processing unit 25 and compression initiating valve release mechanism 11. The fresh mixture transfer ports 78 are shown also.

FIG. 3 shows in enlarged view, hydraulic pump power piston 22 and its start-up, pull-down reciprocating mechanism 32. Piston compression stroke in the start-up mode, motion is produced hydraulically by pressure from starter motor 24. In FIG. 3, hydraulic motor 33 is shown drivably attached to threaded shaft 34 through gear box 35. Shaft 34 can slide piston pull-down fitting 36 back and forth in groove 23 in end fittings 20 and 19. Pull-down fitting 36, can slide along shuttle valve actuator rod 37 in a manner resulting in the shifting of shuttle valve 38 to reverse the direction of motor 33 at each end of travel of fitting 36. Hydraulic motor 33 is connected through flexible shaft 39 to a comparable mechanism on fitting 19. Piston pull-down assembly position indicator switch 40 indicates the position of valve 38.

Figures 4, 4A:
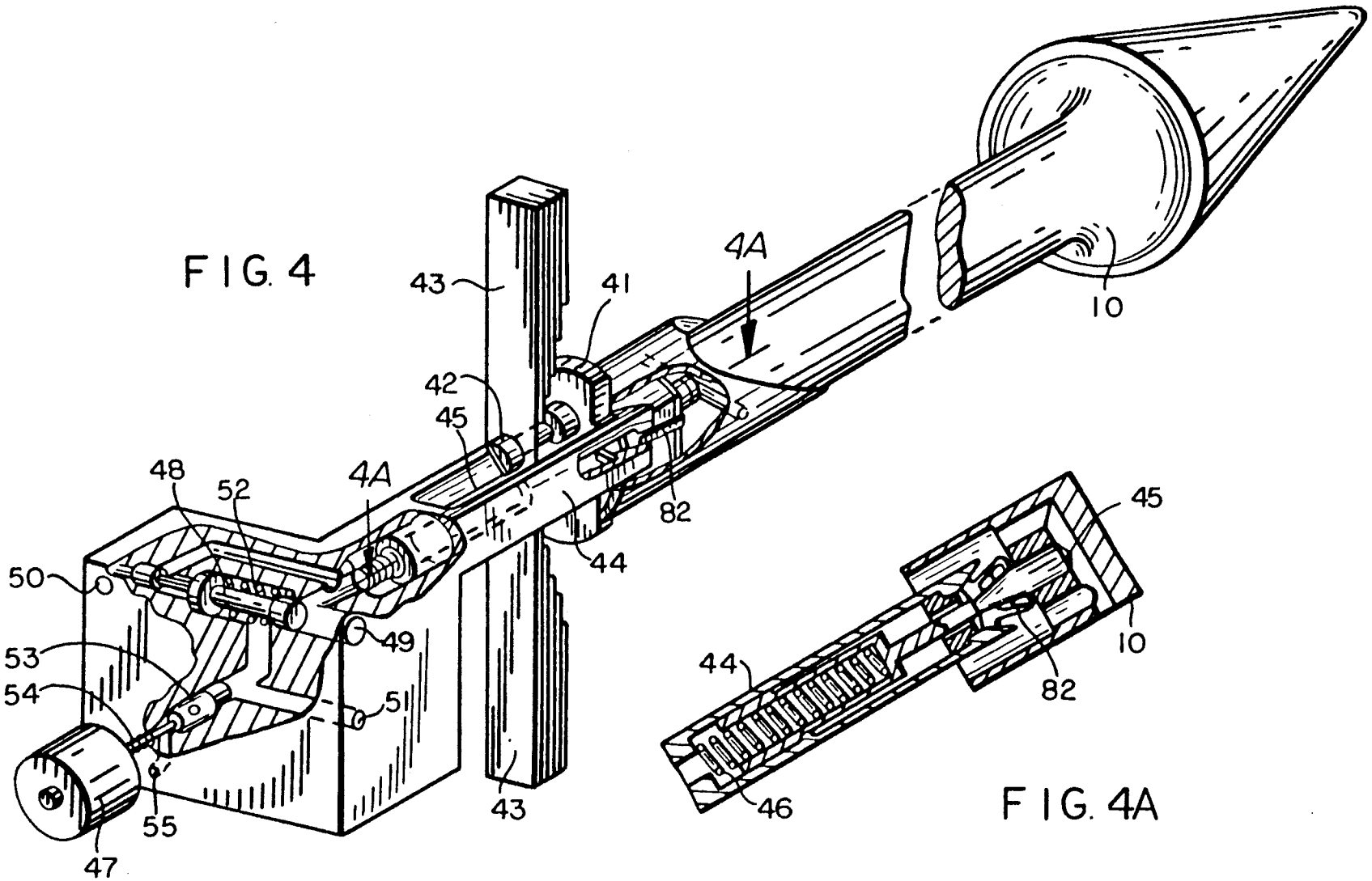
FIG. 4 and 4*a* show an isometric view of the compression initiating valve retention and release mechanism of the system.

FIG. 4 shows the compression initiating valve 10 with retention/release mechanism 11 isolated from its containment structure and in greater detail. Latch fitting 41 is shown attached to valve 10 by screws 42. Screws 42 engage valve return springs 43. Shown also are valve retention/release latch springs 44, valve release cam 45 and valve release cam return spring 46. Also shown are valve release actuator 47, valve release cam actuator plunger 48, valve release cam actuator ports 49, 50 and 51. Valve release cam actuator plunger spring 52, valve release initiator plunger 53, its return spring 54 and its port 55 are also shown along with latch spring spreader blocks 82.

FIG. 5 shows the shut-off valves 15 and 16 associated with the drive motor 12 input and output ports. Comparable shut-off means for the system's minor leakage paths to be closed when no power is required are included. Low pressure accumulator shut-off valve 16 is a simple, spring loaded check-valve, located at the output port 14 of motor 12. High pressure accumulator shut-off valve 15 is located in the input passage 13 of motor 12.

Cam 56 is arranged so that it is rotated by the motion of the vehicles' accelerator pedal to lift shuttle valve 57 by means of lever 60 to feed fluid from accumulator 6 through check valve 81 to the under-faces of valve 15 and piston 58. This equalizes the pressure on valve 15 and applies pressure to piston 58 to open valve 15. This enables valve 15 to be opened prior to the rotation of the motor's swashplate into its drive position.

Check valve 59 feeds fluid from the hydraulic processing unit 25 when the pressure in accumulator 6 is down. Check valve 59A prevents fluid flow from accumulator 6 to reservoir 31 when valve 57 is lifted.

The operation of the system will now be described with reference to the above and the FIGS.

The invention drives road vehicles efficiently by eliminating almost entirely any unnecessary operation of its engine, such as idling. It runs at high efficiency load conditions only with no "part throttle" running and provides as an option the recovery and re-use of a portion of the vehicle's braking energy. It can operate in this manner over wide ranges of atmospheric conditions with mechanisms markedly low in weight, size and cost.

To accomplish this, the unthrottled engine pumps hydraulic fluid into a storage chamber at substantially maximum load and drives its vehicle by feeding to its drive motor just enough fluid to meet its immediate power needs. It's shut-off valves 15 and 16, stop all fluid flow to the drive motor when no power is needed. This eliminates a substantial leakage loss. Optionally, the drive motor is used to pump fluid back into the high pressure storage chamber during braking for re-use as needed.

It achieves the necessary degree of power piston stroke uniformity by raising or lowering the pressure in the fluid storage chambers to meet ambient atmospheric conditions and fuel variations such as high or low octane and alcohol blends. This is achieved by programming the computer to analyze data from barometric pressure sensor 61, air temperature sensor 62 and humidity sensor 63, accumulator pressure sensors 64 and 65 and pertinent engine condition sensors to establish a desired operating pressure. Under the control of computer 66, hydraulic units 24 and 25 charge fluid into or bleed fluid from accumulators 4 and 6 as necessary to establish and maintain that pressure.

At start-up, the synchronization of the pistons is verified or adjusted by the computer-hydraulic unit combination by cycling the pistons and checking for error signals from the piston position sensors 27 and 28. Any needed correction can be made by bleeding or charging by hydraulic processing unit 25. Piston synchronization is monitored and maintained by this process when the system is in use. Cycling the power piston hydraulic pump means 22, draws in air through inlet check-valve 67, mixes it with fuel from fuel injector 68, compresses that mixture in pre-compression chambers 69 and intake manifold, 70, and charges combustion chamber 71.

Combustion engine 72, generates power by compressing the combustible mixture in chamber 71 and igniting it by means of spark timed by computer 66. Combustion and expansion of that mixture drives power piston 22, outward forcing fluid through passages 17; and 18 driving synchronizing piston 8, into main fluid chamber 2. Thus forcing fluid through check valve 9, into accumulator 6 and into variable volume drive motor 12, if vehicle driving power is needed. The forcing, or pumping, of fluid into storage chamber, accumulator 6, compresses gases in the accumulator bladder 73, raising its fluid power level.

As fluid flows from accumulator 6, through port 13 and valve 15 to drive motor 12, its fluid and gas pressure drop. Fluid flows out of drive motor 12, through port 14 and check-valve 16, into low pressure accumulator 4, compressing its gases and raising its pressure. Fluid flow out of accumulator 6, through motor 12 and into accumulator 4 continues as long as power to drive the vehicle is needed. At some pressure level and time interval determined by computer 66, compression initiating valve release mechanism 11 releases valve 10. The release of valve 10 results in fluid flowing out of accumulator 4 into chamber 2 forcing synchronizing piston 8 outward driving piston units 22, toward each other compressing fuel and air mixture in the combustion chamber. As before, a spark initiated by the computer fires that mixture to pump fluid into accumulator 6. This process is repeated, as long as power is used, at a rate dependent upon the rate of power usage. When no power is required, the motor swashplate and cam 56 are rotated into neutral, both shut-off valves close, and internal combustion engine 72 is shut down when the accumulator pressure level criteria are met. At this time any hydraulic circuit subject to accumulator pressure and leakage is shut off.

The compression initiating valve release mechanism 11, is built into the main housing 1 in such a way that all of its elements are in hydraulic communication with passage 3 via passage 80 and subject to its pressure with the exception of valve release actuator 47 and ports 50 and 55. Until such time that the pressure drop in accumulator 6 calls for engine operation, the elements in the valve release mechanism 11 are positioned as shown in FIG. 4. In these positions, valve release cam actuator plunger 48 and valve release cam 45 have equal pressures on each respective face of their pistons. When engine operation is called for, the computer energizes valve release actuator 47 to drive valve release initiator plunger 53 inward (to the right in the FIGURE). This closes off port 51 and opens port 55 to fluid reservoir 31 causing valve release cam actuator plunger 48 to be moved to the right. Movement of plunger 48 to the right results in shutting off port 49 and opening port 50 to reservoir 31 unbalancing the pressures on valve release cam 45 which then moves to the left forcing latch spring spreader blocks 82 to push the latch springs 44 off latch fitting releasing valve 10 to drive piston units 22 inward. When valve release actuator 47 is de-energized, cam 45, plunger 48 and plunger 53 return to their latched positions awaiting the seating of valve 10 upon completion of the engine's compression stroke.

The system can recover braking energy by moving the swashplate of motor 12 to its reverse position thus pumping fluid into accumulator 6, or its equivalent provided for that purpose, while the vehicle moves forward only.

The preferred system's power unit 72 is an unthrottled two-cycle, carbureted spark-ignited engine. The system can be fitted with a power unit of the compression ignition type; but the use of the carbureted, spark-ignited type provides a system which can utilize a larger percentage of the available petroleum resources by a factor of approximately 2-1.

The two-cycle engine is more efficient than the rod and crank four cycle type when operated at speeds allowing sufficient time for full charging of fresh mixture into the combustion chamber. In the invention here-in presented, ample fresh mixture charging time is provided by a built-in computer delay of valve 10's release.

Vehicle speed is controlled by varying the displacement-per-turn of drive motor 12 by the accelerator's varying the angle of the motor's swashplate through an hydraulic servo through speed-direction control lever 74.

To prevent any above-limit flow of fluid from accumulator 6 due to the motor's over speeding as in loss of traction or downhill operation, the system includes a valve of conventional design which bypasses the accelerator operated servo to return the swashplate to neutral.

Obviously, it is possible to use all of the features disclosed in this application in a propulsion system in which the power pistons are driven toward each other by the expanding combustion gases; just the reverse of the arrangement shown. Such an arrangement would have two combustion chambers, one at each end of the cylinder in which the power pistons slide. Such an arrangement would simplify the hydraulic plumbing and mixture induction problems.

Although the description of the preferred embodiment has been given, it is contemplated that various changes could be made without departing from the spirit of the invention as defined by the claims that follow.

I claim:

1. A vehicular drive system including an unthrottled internal combustion powered unit having crankless reciprocating piston means pumping hydraulic fluid intermittently into a high pressure accumulator, an accumulator pressure adjustment means, a valve actuating means controlling the pumping rate of the reciprocating piston means high pressure accumulator shut-off valve means for leakage control, an accelerator controlled variable volume hydraulic motor, a low pressure accumulator storing discharge fluid from said hydraulic motor, a sensor/computer/hydraulic processor means for sequencing:

(i) adjustment of fluid pressures in said accumulators in response to ambient atmospheric conditions, (ii) reciprocation of said reciprocating piston means to achieve synchronization and combustible mixture induction, (iii) release of a compression initiating valve and provision of an ignition spark, (iv) operation of said shut-off valve means for leakage control and accumulator pressure loss prevention.

2. A vehicular drive system in accordance with claim 1 in which said internal combustion powered unit is a two cycle unit and contains:

said reciprocating piston means comprising due opposed power pistons integral with fluid pumping pistons slidable in power and pumping cylinders to pump fluid as expanding gases drive them;

a two-diameter hydraulic piston and matching two-diameter cylinder interposed between pumping cylinders and a main chamber to synchronize said power pistons.

3. A vehicular drive system in accordance with claim 2 in which power piston reciprocation means is provided for reciprocating said power pistons for their synchronization and to start said engine.

4. A vehicular drive system in accordance with claim 2 in which is included an independently driven pumping means whereby the fluid pressure required for said accumulator pressure adjustments, power piston stroking and said power piston synchronization is provided.

5. A vehicular drive system in accordance with claim 2 including said high pressure accumulator joined to said main chamber by a passage containing a check valve and joined to said hydraulic motor of the variable volume type by a fluid passage containing a shut-off valve which is closed when said motor is in a non-driving mode and when loss of traction or other over-speeding takes place.

6. A vehicular drive system in accordance with claim 2 including said low pressure accumulator joined to a discharge port of said hydraulic motor whereby it receives discharge fluid from said hydraulic motor through a check valve and joined to said main chamber by a passage containing said compression initiating valve.

7. A vehicular drive system in accordance with claim 2 including sensors suitably placed to indicate;

(a) air temperature, (b) air pressure, (c) accumulator pressures, (d) power and synchronization piston positions, and (e) hydraulic motor speed and displacement.

8. A vehicular drive system in accordance with claim 2 in which shut-off valve means is provided to prevent leakage from said low and high pressure accumulators through said hydraulic motor when no driving power is needed.

9. A vehicular drive system in accordance with claim 2 including means to prevent excessive loss of fluid from said high pressure accumulator resulting from excessive hydraulic motor speed and displacement.

10. A vehicular drive system in accordance with claim 7 in which said sensor group also indicates air humidity level.

* * * * *